US008458977B2

(12) United States Patent
Gulbrandsen et al.

(10) Patent No.: US 8,458,977 B2
(45) Date of Patent: Jun. 11, 2013

(54) WALL BRACE SUPPORT FOR ACOUSTICAL CEILING TEE

(75) Inventors: Peder Gulbrandsen, Aurora, IL (US); Abraham M. Underkofler, Waukegan, IL (US); Mark R. Paulsen, Beach Park, IL (US); James J. Lehane, Jr., MeHenry, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/332,405

(22) Filed: Dec. 21, 2011

(65) Prior Publication Data

US 2012/0180420 A1 Jul. 19, 2012

Related U.S. Application Data

(60) Provisional application No. 61/428,485, filed on Dec. 30, 2010.

(51) Int. Cl.
*E04B 9/00* (2006.01)

(52) U.S. Cl.
USPC ..... 52/506.08; 52/289; 52/506.07; 248/235; 248/351

(58) Field of Classification Search
USPC ..... 52/220.6, 289, 506.07–506.1, 665; 248/342–344, 235, 240, 241, 351
See application file for complete search history.

(56) References Cited

U.S. PATENT DOCUMENTS

| | | | | |
|---|---|---|---|---|
| 653,000 | A * | 7/1900 | Dundon | 248/351 |
| 931,995 | A * | 8/1909 | Clack et al. | 248/235 |
| 1,738,469 | A * | 12/1929 | Weiss | 52/506.09 |
| 3,390,856 | A * | 7/1968 | Van Buren, Jr. | 248/317 |
| 3,594,970 | A * | 7/1971 | MacGrath et al. | 52/506.07 |
| 3,599,921 | A * | 8/1971 | Cumber | 248/317 |
| 3,612,461 | A * | 10/1971 | Brown | 248/317 |
| 3,677,589 | A * | 7/1972 | Roles | 403/217 |
| 3,998,419 | A * | 12/1976 | Semmerling | 248/323 |
| 4,040,758 | A * | 8/1977 | Sauer | 403/397 |
| 4,479,341 | A * | 10/1984 | Schuplin | 52/665 |
| 4,715,161 | A * | 12/1987 | Carraro et al. | 52/714 |
| 4,905,952 | A * | 3/1990 | Pinquist | 248/317 |
| 5,937,605 | A * | 8/1999 | Wendt | 52/506.06 |
| 7,552,567 | B2 * | 6/2009 | Ingratta et al. | 52/506.07 |
| 2006/0096219 | A1 * | 5/2006 | Ingratta et al. | 52/506.07 |
| 2008/0060306 | A1 * | 3/2008 | Platt et al. | 52/506.06 |
| 2009/0301010 | A1 * | 12/2009 | Kelly et al. | 52/220.6 |
| 2011/0011023 | A1 * | 1/2011 | Gulbrandsen et al. | 52/506.07 |
| 2011/0146194 | A1 * | 6/2011 | Tedesco et al. | 52/665 |
| 2011/0283634 | A1 * | 11/2011 | Underkofler et al. | 52/167.1 |

FOREIGN PATENT DOCUMENTS

| | | | |
|---|---|---|---|
| EP | 639681 | A2 * | 2/1995 |

* cited by examiner

*Primary Examiner* — Brian Glessner
*Assistant Examiner* — Adriana Figueroa
(74) *Attorney, Agent, or Firm* — Pearne & Gordon LLP

(57) ABSTRACT

A wall brace support for an acoustical ceiling tee having a bulb includes an elongated main portion having two ends; a wall attachment tab at one of the ends, the tab being operable to abut the wall and receive at least one fastener therethrough to fasten the tab to the wall; and an acoustical ceiling tee attachment structure at the other end, the structure being operable to receive at least one fastener therethrough to fasten the structure to the bulb at a location spaced away from the wall.

5 Claims, 2 Drawing Sheets

WALL BRACE SUPPORT FOR ACOUSTICAL CEILING TEE

This application claims the priority of U.S. Provisional Application No. 61/428,485, filed Dec. 30, 2010.

BACKGROUND OF THE INVENTION

The present invention relates to suspended ceilings and in particular to suspending ceiling grids used to support ceiling tiles.

When installing suspended tile ceilings in relatively narrow hallways or other small areas, it can be advantageous to take advantage of the proximity of the opposite walls by just spanning the wall distance with an acoustical ceiling tee that is not supported by the usual hanger wires or similar devices that attach to the deck or other overhead structures. Instead, the acoustical ceiling tee between the walls is just supported at the walls by the wall molding. In general, it may be possible to span up to six feet before too much deformation occurs in commonly used acoustical ceiling tees.

SUMMARY OF THE INVENTION

A wall brace support for an acoustical ceiling tee having a bulb includes an elongated main portion having two ends; a wall attachment tab at one of the ends, the tab being operable to abut the wall and receive at least one fastener therethrough to fasten the tab to the wall; and an acoustical ceiling tee attachment structure at the other end, the structure being operable to receive at least one fastener therethrough to fasten the structure to the bulb at a location spaced away from the wall.

DESCRIPTION OF THE PREFERRED EMBODIMENTS

Figure 1:
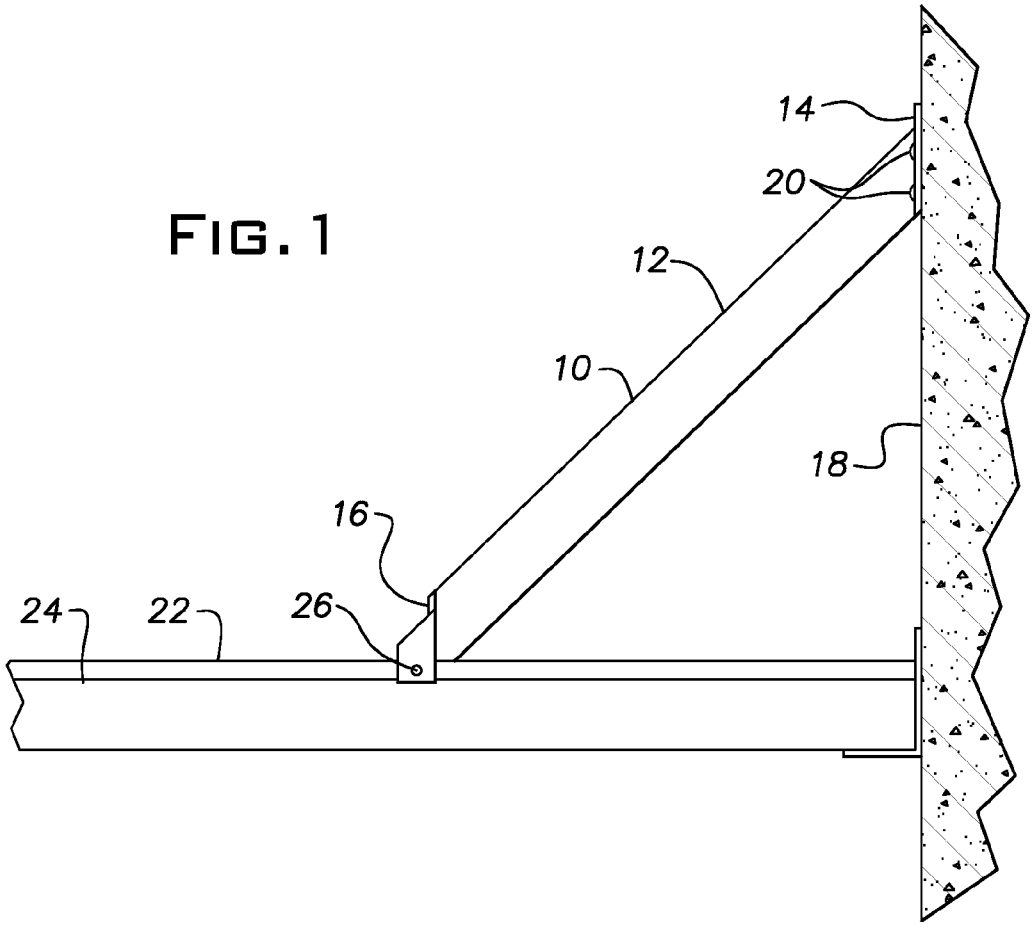
FIG. 1 is a front elevation view of an example according to some aspects of the invention showing a wall brace support in use.
Figure 4:
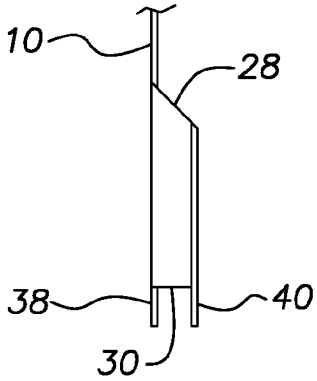
FIG. 4 is a cross section view along the line 4-4 of FIG. 3.

Referring to FIG. 1, a wall brace support 10 includes an elongated main portion 12, a wall attachment tab 14 at one end and an acoustical ceiling tee attachment structure 16 at the other end. The support 10 may be, for example, formed from a strip of rigid material such as steel, aluminum or plastic and be 10-20 inches long.

In use, the tab 14 is fastened to the wall 18 with fasteners 20 and the structure 16 is attached to the bulb 22 of an acoustical ceiling tee 24 with the fastener 26 and optionally another unshown fastener from the opposite side of the bulb 22. The fasteners 20, 26 may be, for example, screws, nails or pop rivets. The location of the attachment of structure 16 may be, for example, 7-14 inches from the wall 18.

When combined with the same arrangement at the opposite wall, the span of the acoustical ceiling tee 24 without hangers can be extended, for example, from six to eight feet between walls when supporting ceiling tiles.

Referring to FIGS. 1-4, the tab 14 may be, for example, bent out from the main portion 12 in a manner to provide an angle of 40-50 degrees between the wall 18 and the support 10. The structure 16 may be, for example, formed from the main portion 12 by forming an offset 28 in the main portion 12 and providing a notch 30 in the offset 28. The tab 14 and the structure 16 may be conveniently provided with holes 32, 34 to receive fasteners. The overall rigidity of the support 10 can be enhanced by embossing the support 10.

Figure 5:
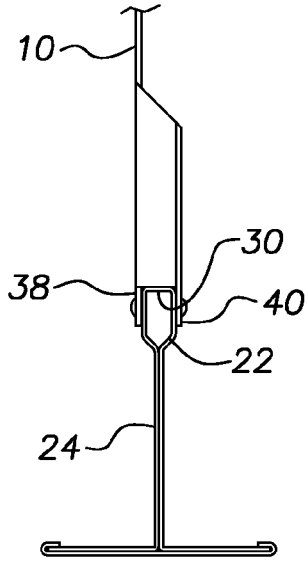
FIG. 5 is FIG. 4 with a cross section view of an acoustical ceiling tee added showing the wall brace support in use.
Figure 2:
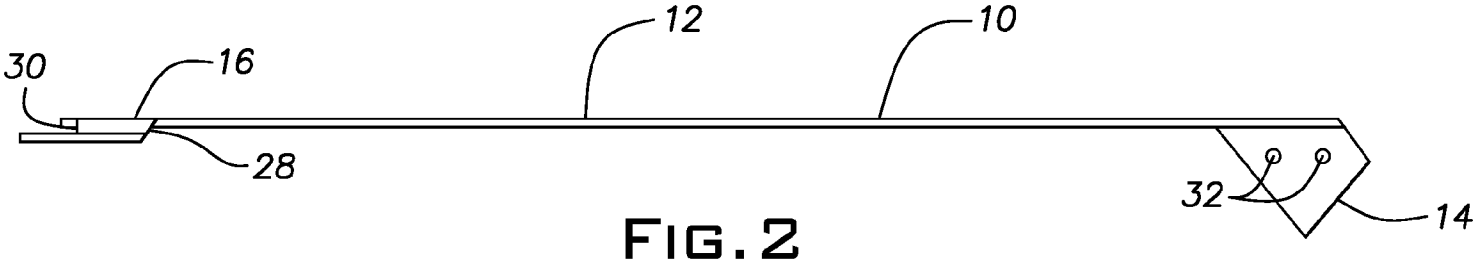
FIG. 2 is a top plan view an example of a wall brace support according to some aspects of the invention.
Figure 3:
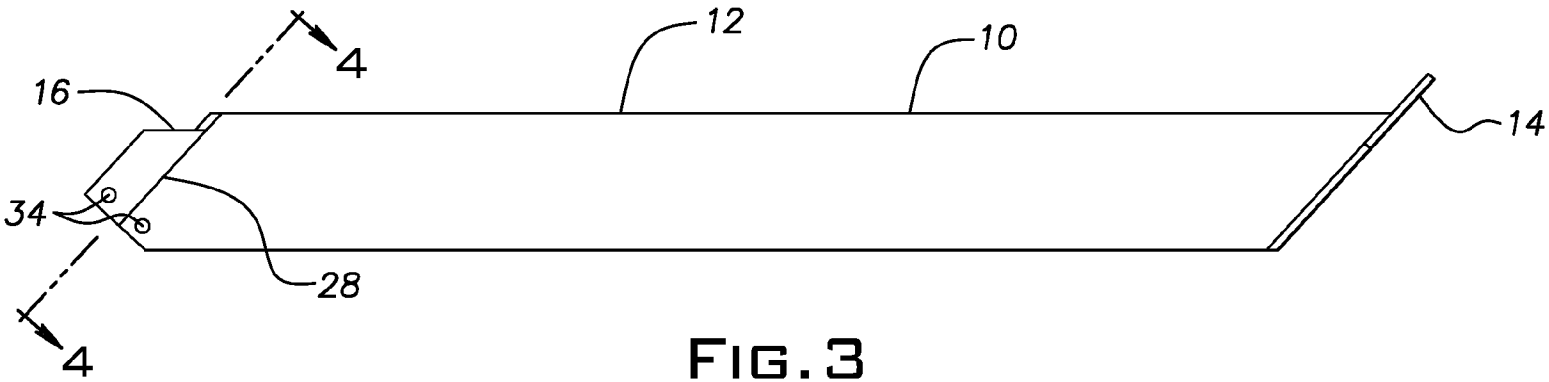
FIG. 3 is a side elevation view of the wall brace support of FIG. 2.

Referring to FIG. 5, when installed, the structure 16 straddles the bulb 22. The bulb 22 is received in the notch 30 with the portion 38 of the structure 16 before the notch 30 on one side of the bulb 22 and the portion 40 after the notch 30 on the other side of the bulb 22.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A wall brace support for an acoustical ceiling tee having a bulb, said tee extending away from a wall, said support being made of a single strip of rigid material and comprising:

an elongated generally planar main portion having two ends;

a substantially flat wall attachment tab at one of said ends, the tab lying in a plane transverse to the plane of the main portion and oblique to a longitudinal direction of the main portion, said tab being operable to abut said wall and including a hole to receive at least one fastener therethrough to fasten said tab to said wall; and an acoustical ceiling tee attachment structure at the other one of said ends, said structure including a hole operable to receive at least one fastener therethrough to fasten said structure to said bulb at a location spaced away from said wall, said tab and structure being respective bent end portions of said strip, the structure including an offset on said elongated main portion, a notch at a bottom of said offset, said notch being operable to receive said bulb with portions of said structure being disposed in parallel relation to the main portion and adapted to abut opposite vertical sides of said bulb.

2. A wall brace support according to claim 1, wherein said support is proportioned to dispose said location at 6-14 inches from said wall.

3. A wall brace according to claim 1, wherein said bent end portions are on a common side of the plane of said main portion.

4. A wall brace according to claim 3, wherein said tab and said offset are bent on generally parallel lines.

5. A wall brace according to claim 1, wherein the notch and offset are co-extensive in a direction of the offset.

* * * * *

UNITED STATES PATENT AND TRADEMARK OFFICE

CERTIFICATE OF CORRECTION

PATENT NO. : 8,458,977 B2
APPLICATION NO. : 13/332405
DATED : June 11, 2013
INVENTOR(S) : Peder Gulbrandsen et al.

It is certified that error appears in the above-identified patent and that said Letters Patent is hereby corrected as shown below:

On the Title page, Item (75) Inventors: James J. Lehane, Jr., delete "MeHenry, IL (US)" and insert --McHenry, IL (US)--.

Signed and Sealed this
Sixth Day of August, 2013

Teresa Stanek Rea
*Acting Director of the United States Patent and Trademark Office*